US007219890B2

(12) United States Patent
White

(10) Patent No.: US 7,219,890 B2
(45) Date of Patent: May 22, 2007

(54) VALVE SYSTEM FOR THE COUNT ROLL OF AN INTERFOLDING MACHINE

(75) Inventor: Barton J. White, Freedom, WI (US)

(73) Assignee: FPNA Acquisition Corporation, Green Bay, WI (US)

( * ) Notice: Subject to any disclaimer, the term of this patent is extended or adjusted under 35 U.S.C. 154(b) by 189 days.

(21) Appl. No.: 10/957,006

(22) Filed: Oct. 1, 2004

(65) Prior Publication Data

US 2005/0073089 A1 Apr. 7, 2005

Related U.S. Application Data

(60) Provisional application No. 60/508,580, filed on Oct. 3, 2003.

(51) Int. Cl.
*B65H 5/02* (2006.01)

(52) U.S. Cl. ..... 271/276; 271/196

(58) Field of Classification Search ..... 271/276, 271/183, 196; 493/450
See application file for complete search history.

(56) References Cited

U.S. PATENT DOCUMENTS 4,838,982 A * 6/1989 Klaeser et al. ..... 156/520
5,480,137 A * 1/1996 Haupenthal ..... 271/276
6,688,594 B2 * 2/2004 Dunninger et al. ..... 271/275
2003/0020232 A1 * 1/2003 Kobayashi et al. ..... 271/276
2003/0047866 A1 * 3/2003 Dunninger et al. ..... 271/276

FOREIGN PATENT DOCUMENTS

EP 1 026 114 8/2000
EP 1 371 593 12/2003

* cited by examiner

*Primary Examiner*—David H. Bollinger
(74) *Attorney, Agent, or Firm*—Boyle, Fredrickson, Newholm, Stein & Gratz, S.C.

(57) ABSTRACT

An interfolding machine includes an assembly for and method of separating overlapped sheets of material at a desired sheet count. The assembly includes a vacuum assembly with a manifold having a plurality of vacuum inlet ports coupled to a valve body having a plurality of chambers. A spool is contained within the valve body and includes a plurality of ports to provide a plurality of respective vacuum paths to a rotating count roll. The spool also includes a plurality of inlet openings in its outer surface. Each opening in the spool communicates a respective set of count roll vacuum ports with a respective interior chamber of the valve body. A control valve selectively releases the vacuum pressure in the vacuum chambers to atmosphere. The selective application of vacuum pressure to the holes in the count roll creates a fold that separates the sheets to form separate stacks of sheets at the discharge of the interfolding machine.

8 Claims, 6 Drawing Sheets

VALVE SYSTEM FOR THE COUNT ROLL OF AN INTERFOLDING MACHINE

RELATED APPLICATIONS

This application claims the benefit under 35 U.S.C. § 119(e) of U.S. Provisional Application Ser. No. 60/508,580, filed Oct. 3, 2003, the entirety of which is hereby incorporated herein by reference.

FIELD OF THE INVENTION

This invention generally relates to an interfolding machine for folding sheets of material, and more specifically, to an interfolding machine that includes a count roll to form a separation in a stack of interfolded sheets at a predetermined sheet.

BACKGROUND OF THE INVENTION

Interfolding of a web or sheet material (e.g., napkins, paper towels, tissue, etc.) is frequently performed using folding rolls of a folding machine. The folding rolls are operable to fold a series of successive sheets that are cut from one or more webs and supplied to the folding rolls in an overlapping relationship. Upstream of the folding rolls, the sheets are cut against a bed roll by a knife roll, and the sheets are then supplied to a retard roll that functions to provide the desired overlapping relationship of the sheets. From the retard roll, the sheets are advanced by a lap roll and are then supplied to the folding rolls for interfolding, to create a stack of interfolded sheets at the discharge of the folding rolls. A count roll is located adjacent the lap roll, and rotates in a timed relationship with the lap roll. The count roll is selectively operable to eliminate the sheet overlap at a desired sheet count, in order to create a separation in the supply of overlapped sheets to the folding rolls. The separation in the supply of sheets to the folding rolls functions to separate the stack of sheets discharged from the folding rolls into adjacent stacks or logs of sheets, each of which has a desired sheet count. The sheet overlap is interrupted by means of a vacuum system in the count roll that folds the leading edge of one of the sheets onto itself at the desired count. As the count roll rotates, the vacuum system is selectively actuated to engage the leading edge of the sheet as the sheets is transported on the lap roll, and carries and/or retains the leading edge of the sheet while the remainder of the sheet is advanced by the lap roll. The count roll then releases the leading edge of the sheet, and the retention of the remainder of the sheet on the count roll creates the sheet fold that eliminates the overlap between the leading edge of the sheet and the trailing edge of the downstream sheet.

However, known count roll systems for interfolding machines have drawbacks and limitations. For example, the operational speed of the interfolding machine is limited by a relatively short switching time that is available for actuating the vacuum system to turn the count roll valves on and off. Further, known count rolls use two vacuum ports on the count roll that are 180° apart, which can only provide an even count of sheets.

SUMMARY OF THE INVENTION

In accordance with the present invention, there is provided a count assembly that provides the ability to form a separation of successive sheets of material through an interfolding machine at a desired sheet count. The count assembly includes a count roll that is selectively supplied with vacuum from a vacuum assembly, which includes a manifold having a plurality of manifold ports coupled to a valve body having a plurality of interior chambers. A spool is located within a cavity defined by the valve body. The spool includes a plurality of spool ports to provide a plurality of respective vacuum paths to a rotating count roll. The spool also includes a plurality of machined openings along a perimeter or outer surface, and each machined opening in the spool communicates a respective manifold port with a respective interior chamber disposed in the valve body.

The invention also provides an interfolding machine for interfolding sheets of material, which are separated at a predetermined count of sheets. The interfolding machine includes a roll configured to count successive sheets of the material through the interfolding machine. The roll generally includes a series of holes or ports configured to communicate vacuum to the surface of the roll at a predetermined sheet count and at a desired point in rotation of the roll. The interfolding machine further includes a vacuum assembly that selectively communicates vacuum pressure to the holes or ports of the roll. The vacuum assembly includes a manifold having a series of manifold ports, and a valve body having a series of chambers, each of which is in communication with one of the series of manifold ports. The vacuum assembly further includes a spool inserted in the valve body. The spool is connected to the roll so as to rotate with the roll, and includes a plurality of spool ports along a circumference thereof to provide respective paths to communicate the vacuum pressure to the holes or ports of the folding roll. Each opening in the spool communicates one of the manifold openings with one of the chambers of the valve body. The vacuum assembly further includes a control valve for selectively exposing at least one of the valve chambers to atmosphere such that the roll selectively releases the web material at a predetermined point in rotation of the roll.

The invention also provides a method of separating successive sheets of overlapped sheets of material at a desired sheet count. The method generally includes the acts of providing a control valve, a spool, and a count roll, the count roll configured to create a fold separating the successive sheets of web material at a desired sheet count. The spool includes a plurality of chambers, each of which is configured to communicate a vacuum pressure at a plurality of ports along a perimeter of the spool with a plurality of holes in an outer surface of the count roll. The method further includes the acts of rotating the spool with respect to the control valve; aligning one or more of the chambers in the spool with an opening in the control valve; communicating one or more of the aligned chambers with atmosphere via the opening in the control valve; and releasing the vacuum pressure in one or more of the aligned chambers to atmosphere.

Other objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout. In the drawings.

DETAILED DESCRIPTION OF THE PREFERRED EMBODIMENTS

1. Folding Machine

Figure 1:
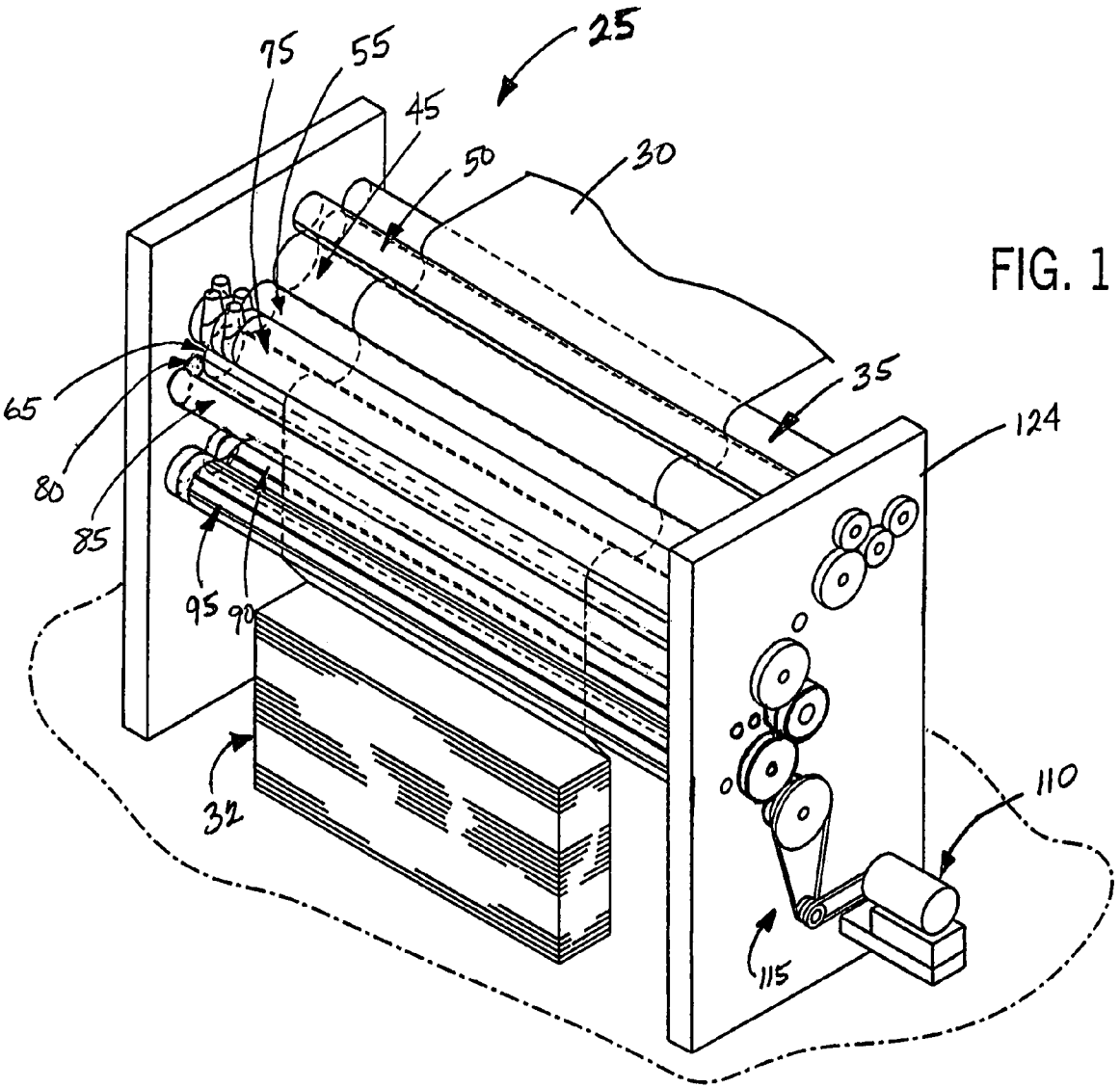
FIG. 1 is an isometric view of an interfolding machine employing a count roll valve system in accordance with the present invention.
Figure 2:
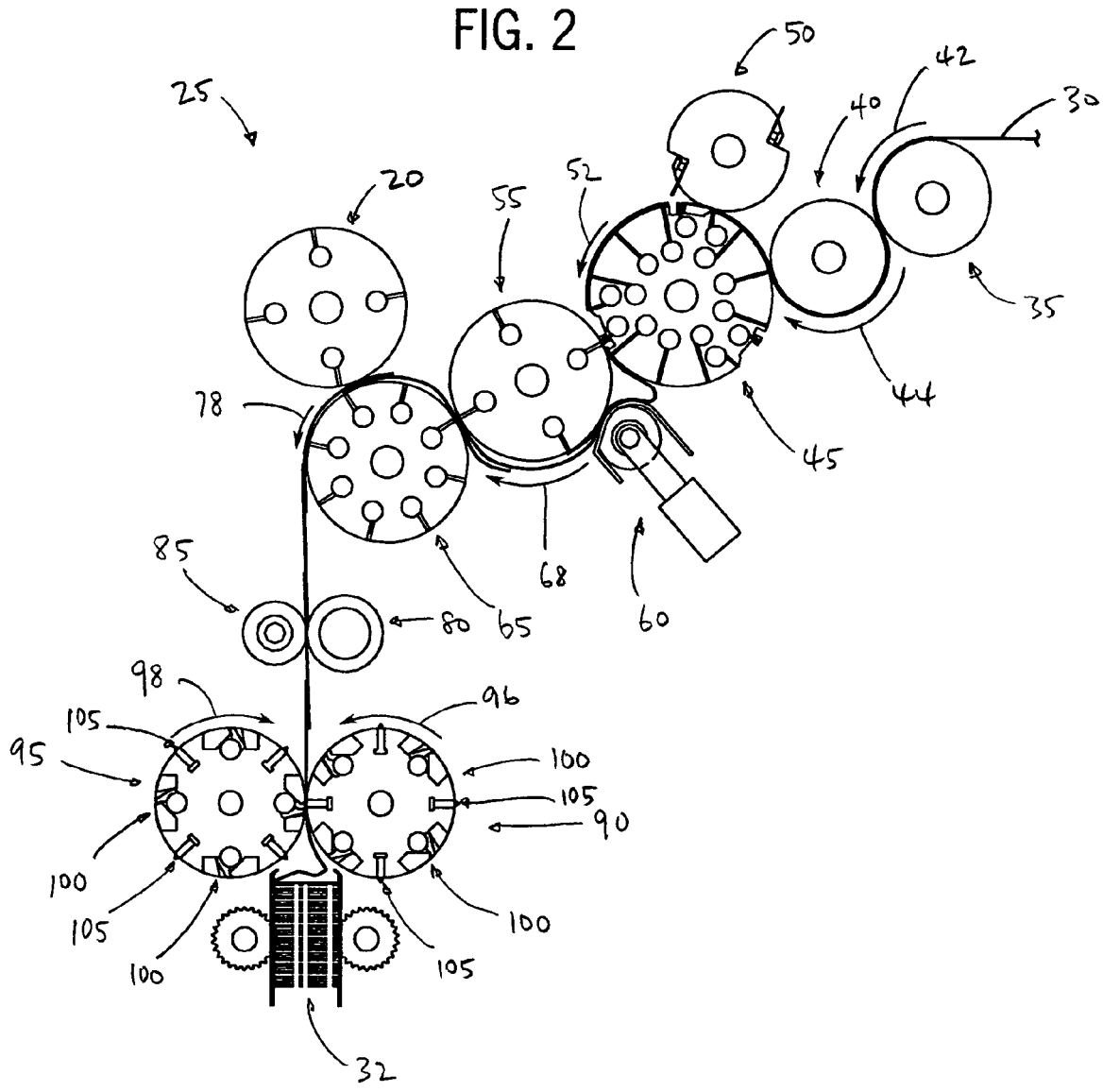
FIG. 2 is a schematic side elevation view of the interfolding machine as shown in FIG. 1.
Figure 3:
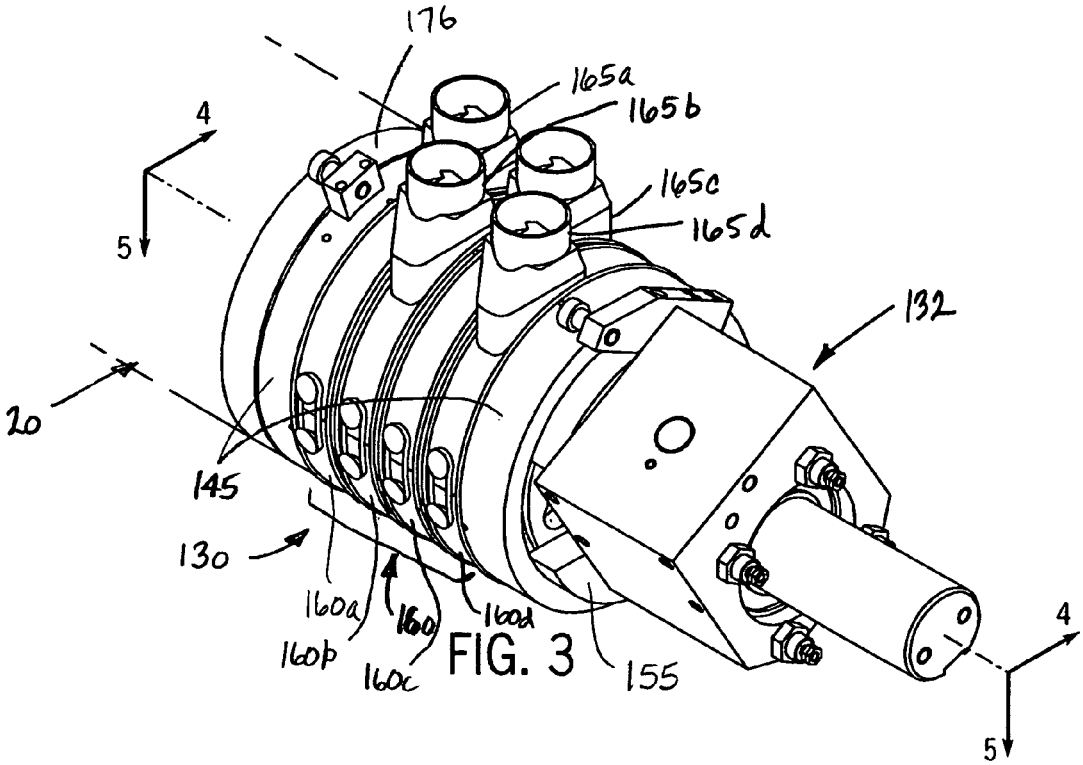
FIG. 3 is a detailed isometric view of a count roll valve assembly incorporated in the interfolding machine of FIGS. 1 and 2.
Figure 6:
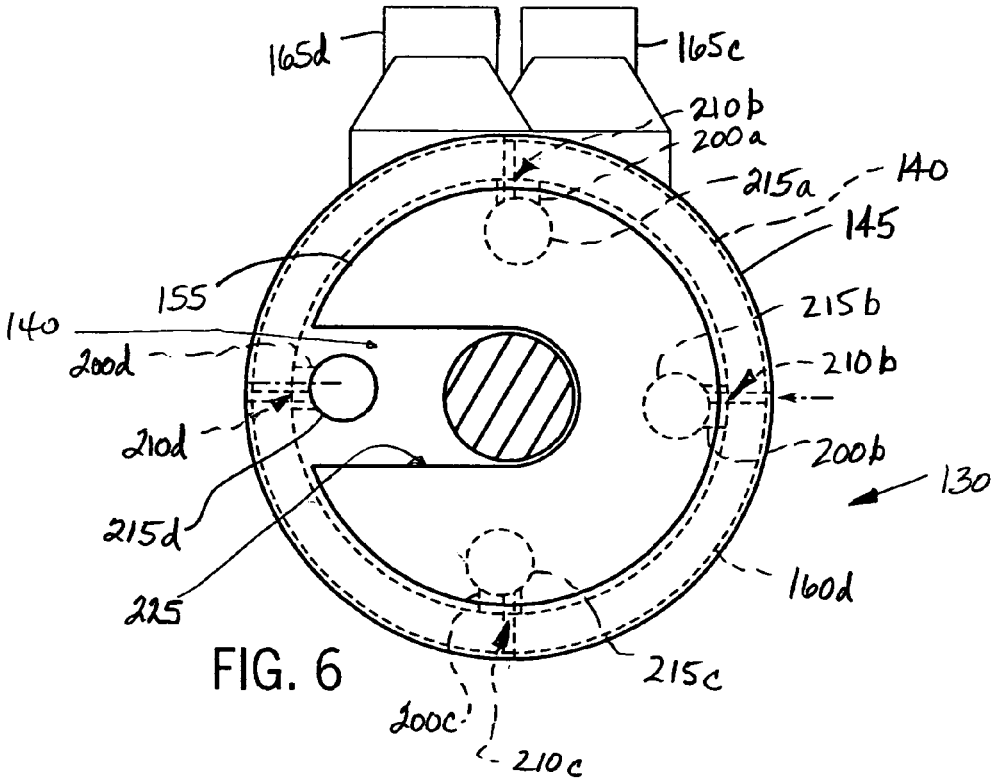
FIG. 6 is a cross-sectional view of the count roll valve assembly along line 6—6 of FIG. 4.

Referring to FIGS. 1 and 2, an interfolding machine 25 is operable to convert a web of material 30 into a stack of interfolded sheets of material shown at 32. Interfolding machine 25 incorporates a count roll valve system in accordance with the present invention, and generally includes a first pull roll 35 and a second pull roll 40 that receive the web of material 30 along a path (illustrated by an arrow 42 in FIG. 2) from a supply roll (not shown) into the interfolding machine 20. The first and second pull rolls 35 and 40 define a nip through which the web of material 30 passes, and function to unwind the web of material 30 and feed the web of material 30 in a path (illustrated by an arrow 44 in FIG. 2) toward a nip defined between second pull roll 40 and a bed roll 45. The web of material 30 is then advanced by bed roll 45 toward a knife roll 50. In a manner as is known, the knife roll 50 cuts the web of material 30 into sheets, each of which has a predetermined length, and the bed roll 45 carries the sheets of material along a path (illustrated by arrow 52 in FIG. 2) toward and through a nip defined between bed roll 45 and a retard roll 55, which rotates at a slower speed of rotation than the bed roll 45. In a manner as explained in copending application Ser. No. 10/953,175 filed Sep. 24, 2004, the retard roll 55 cooperates with a nip roller assembly 60 (FIG. 2) to form an overlap between the consecutive sheets of material. The retard roll 55 carries the overlapped sheets of material along a path (illustrated by arrow 68 in FIG. 2) to a lap roll 65.

The lap roll 65 works in combination with the count roll 20 to eliminate the overlap between adjacent sheets of material at a predetermined sheet count, so as to create a separation in the stack 32 of interfolded sheets discharged from the interfolding machine 25. The lap roll 65 carries the overlapped sheets 30 along a path (illustrated by arrow 78 in FIG. 2) toward a nip defined between a first assist roll 80 and an adjacent second assist roll 85. The first and second assist rolls 80 and 85 feed the sheets of the material to a nip defined between a first folding roll 90 and a second folding roll 95.

Referring to FIG. 2, the first and second folding rolls 90 and 95 generally rotate in opposite directions (illustrated by arrows 96 and 98, respectively, in FIG. 2) to receive the overlapped sheets of material 30 therebetween. The periphery of the first folding roll 90 generally includes a series of the tucker assemblies 105 and gripper assemblies 100 uniformly and alternately spaced to interact with a series of tucker assemblies 105 and gripper assemblies 100 of the adjacent second folding roll 95. The series of alternately spaced tucker assemblies 105 and gripper assemblies 100 of the first and second folding rolls 90 and 95 interact to grip, carry, and release the sheets of material in a desired manner so as to form stack 32 of interfolded sheets. The folding rolls 90 and 95 may be driven by a drive system 110 having a drive belt assembly 115 (FIG. 1).

The stack 32 of interfolded sheets is discharged from between the first and second folding rolls 90 and 95 in a generally vertically-aligned fashion. The stack 32 of interfolded sheets may be supplied to a discharge and transfer system (not shown), which guides and conveys the stack 32 from the generally vertically-aligned orientation at the discharge of the interfolding machine 25 to a generally horizontally-aligned movement. One embodiment of a suitable discharge and transfer system is described in U.S. Pat. No. 6,712,746 entitled "Discharge and Transfer System for Interfolded Sheets," filed May 5, 2000, the disclosure of which is hereby incorporated herein by reference in its entirety. Another representative discharge and transfer system is illustrated in copending application Ser. No. 10/610,458 filed Jun. 30, 2003, now U.S. Pat. No. 6,865,861 issue Mar. 15, 2005, the disclosure of which is also hereby incorporated herein by reference in its entirety.

2. Count Roll Assembly

FIGS. 3–7 show a count roll valve assembly 130 of the present invention, which is mounted to each end of count roll 20. Count roll 20 is rotatably mounted to the frame of interfolding machine 25 by a pair of bearing box assemblies 132. Each count roll valve assembly 130 generally includes a pair of ball bearings 135, a rotating spool 140, a valve body 145, a pair of wear plates 150, an OFF valve 155, and a manifold cover 160.

The rotating spool 140 of the count valve assembly 130 slips over a roll journal 170, such that roll journal 170 is received within an internal passage 142 defined by spool 140. Each roll journal 170 includes a flange 176 that is directly connected one of the ends of count roll 20, in a manner as is known. Flange 176 defines port paths 185 that are aligned and communicate with port paths 185 that open onto the ends of count roll 20. Port paths 185 of flange 176 communicate with separate interior chambers or passages 200*a*–*d* formed in the body of spool 140.

The rotating spool 140 also includes radially and axially spaced machined openings or ports 210*a*–*d* that open onto the outer surface 212 of the body of spool 140. Each opening 210*a*–*d* communicates with one of the separate interior chamber 200*a*–*d* disposed in the spool 140, establishing communication with the outer surface of spool 140. Each chamber 200*a*–200*d* connects one of the distinct openings 210*a*–*d* to one of the respective port paths 185*a*–*d* and to the respective holes 218*a*–*d* along the outer surface of the count roll 20.

Figure 4:
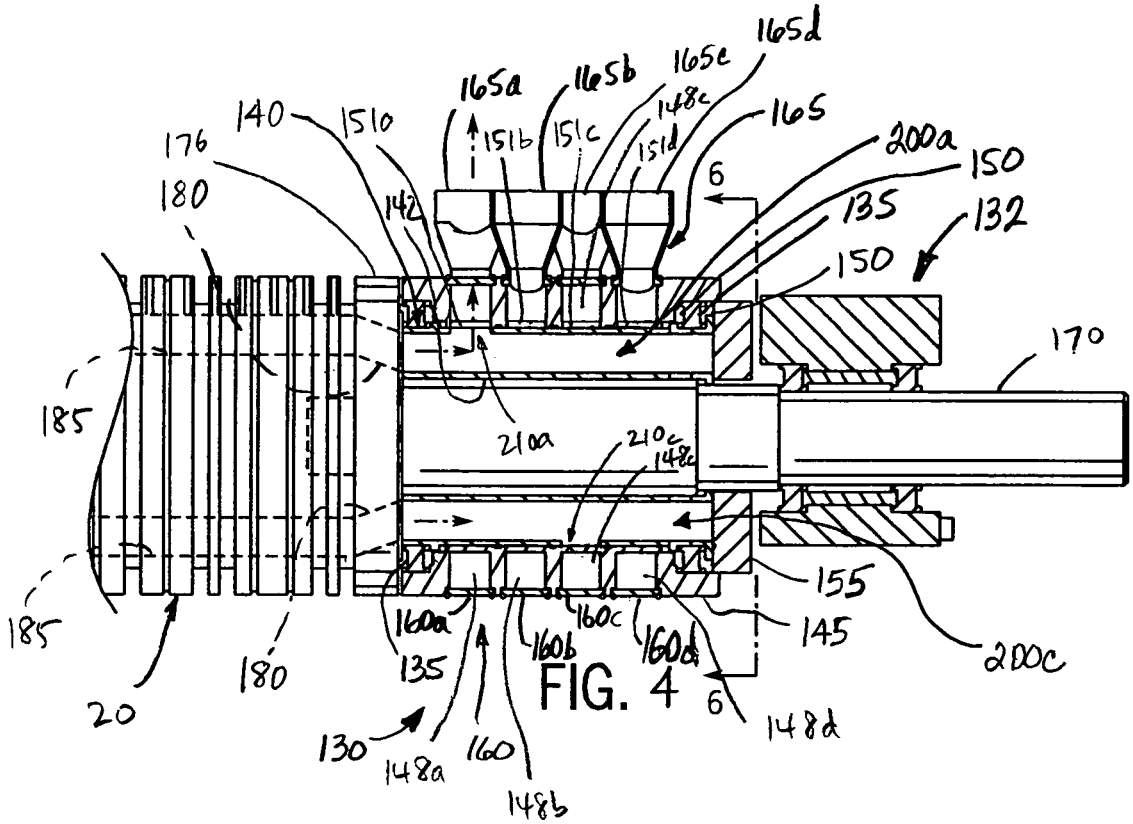
FIG. 4 is a first detailed cross-sectional view of the count roll valve assembly along line 4—4 of FIG. 3.
Figure 5:
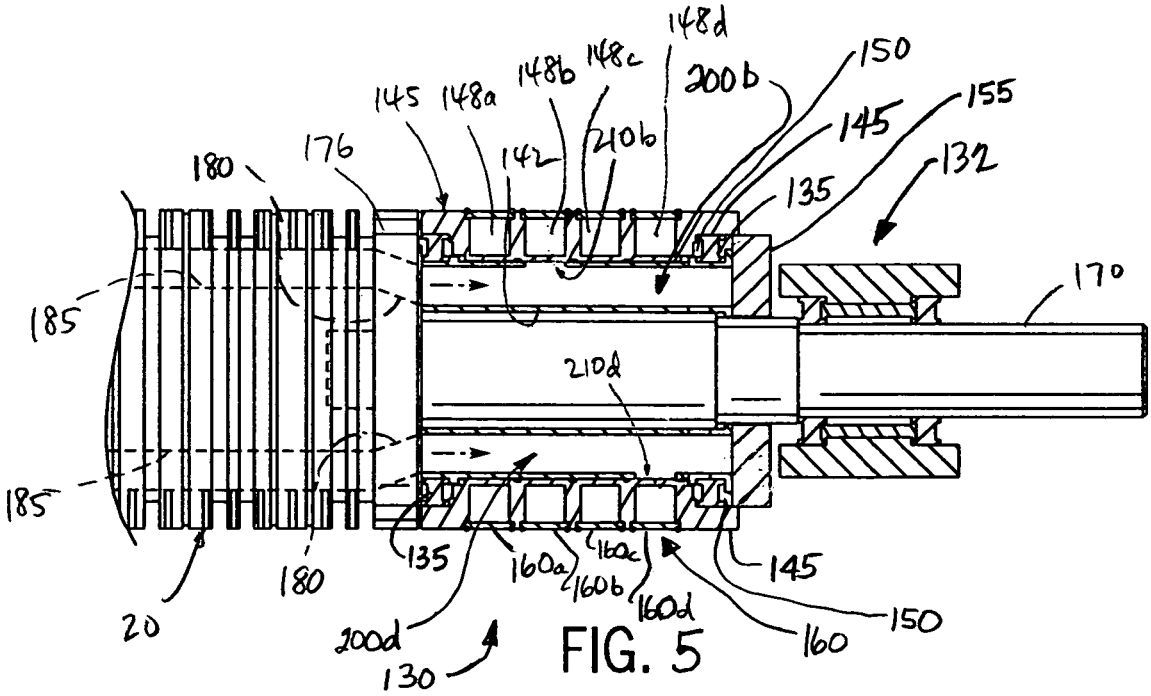
FIG. 5 is a second detailed cross-sectional view of the count roll valve assembly along line 5—5 of FIG. 3.
Figure 7:
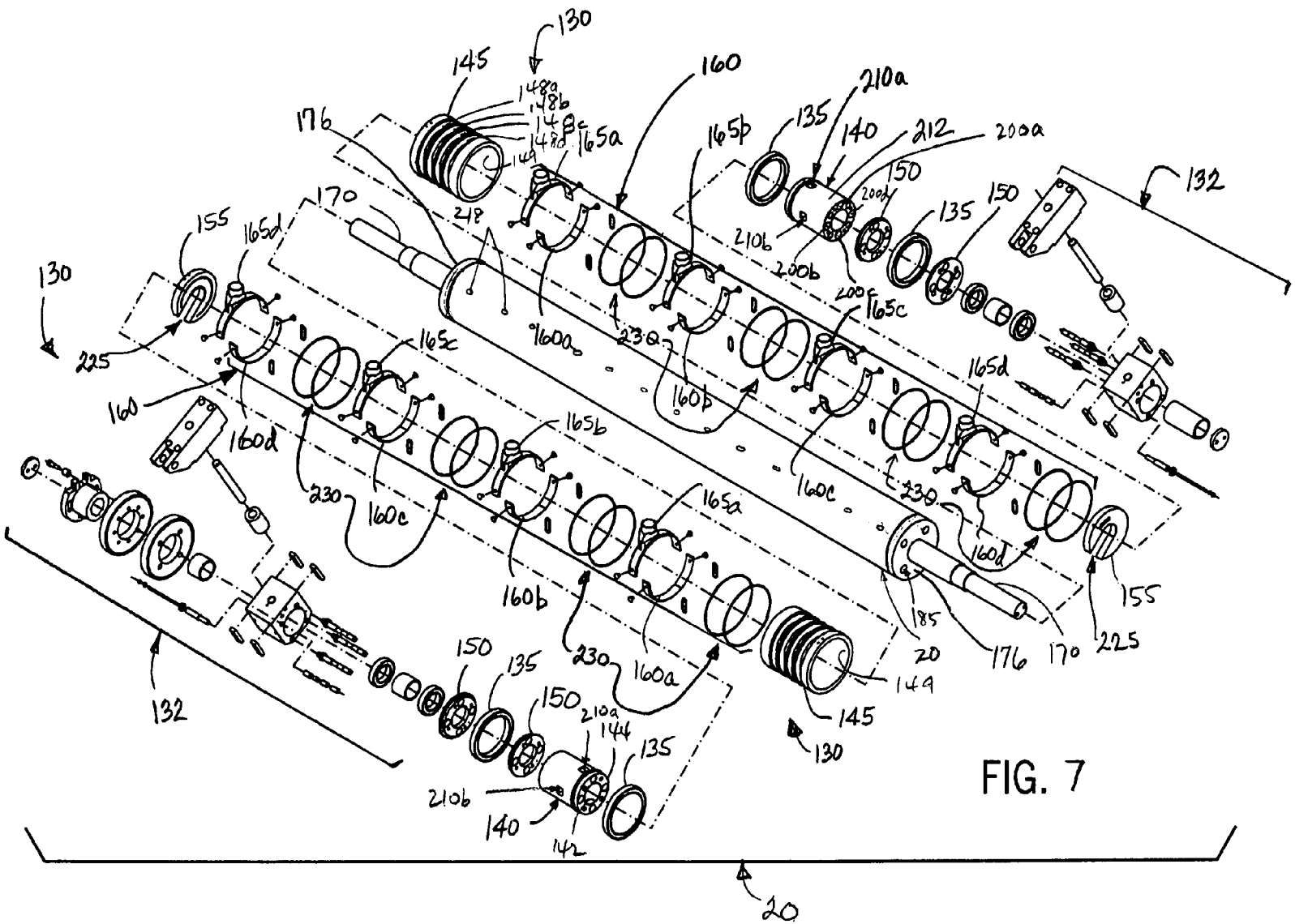
FIG. 7 is an exploded isometric view of the count roll valve assembly shown in FIG. 3.

The valve body 145 does not rotate, and is supported on spool 140 by bearings 135, which are affixed to the ends of spool 140 and within inwardly facing recesses formed in the ends of valve body 145. Wear plates 150 straddle the outer one of bearings 135 at the bearing box 132/frame side 222 (See FIG. 1) of the assembly 20. Valve body 145 is a generally cylindrical member, and includes a series of circumferential recesses 148*a*, 148*b*, 148*c* and 148*d* that extend inwardly from its outer surface. Valve body 145 defines an interior 149 within which spool 140 is received, and recesses 148*a*–148*d* communicate with valve body interior 149 through respective passages 151*a*–151*d* (FIGS. 4,5).

Manifold 160 generally includes a series of four C-shaped cover components 160*a*–*d* interconnected with a series of four C-shaped vacuum inlet components 165*a*–*d*. The width of each of the cover components 160*a*–*d* and respective vacuum inlet components 165*a*–*d* can vary. The preferred cover components 160*a*–*d* each extends a first portion of the circumference of the manifold 160, and each of the vacuum inlet components 165*a*–*d* extends the remaining circumference of the manifold 160. The manifold 160 further includes a series of gaskets 230 disposed between adjacent cover components 160*a*–*d* and vacuum inlet components 165*a*–*d*. Respective cover components 160*a*–160*d* and respective vacuum inlet components 165*a*–165*d* are secured together to enclose respective valve body recesses 148*a*–148*d*. With this construction, manifold 160 defines a series of annular vacuum supply cavities, each of which is supplied with vacuum from a vacuum source connected to vacuum inlet components 165*a*–165*d*, and which communicate with valve body interior through passages 151*a*–151*d*. Of course, the specific construction of manifold 160 may vary form that which is shown and described, which is not limiting on the invention.

The OFF valve 155 is generally a port cover plate structure that overlies the end of the spool 140 opposite plate portion 144. OFF valve 155 is spring-loaded, stationary and presses against the outer wear plate 150. In the illustrated embodiment, OFF valve 155 generally includes a U-shaped opening 225 through which roll journal 170 extends. Opening 225 in OFF valve 155 selectively communicates chambers or passages 200*a*–*d* with atmosphere during rotation of count valve 20 and spool 140. When the energized or activated port passes the U-shaped cutout in valve 155, the respective port is exposed to the atmosphere, which functions to cut off the supply of vacuum pressure to the holes 218*a*–*d* of the count roll 20. This release of vacuum pressure functions to release engagement of the sheet 30 with the outer surface of count roll 20.

Figure 9:
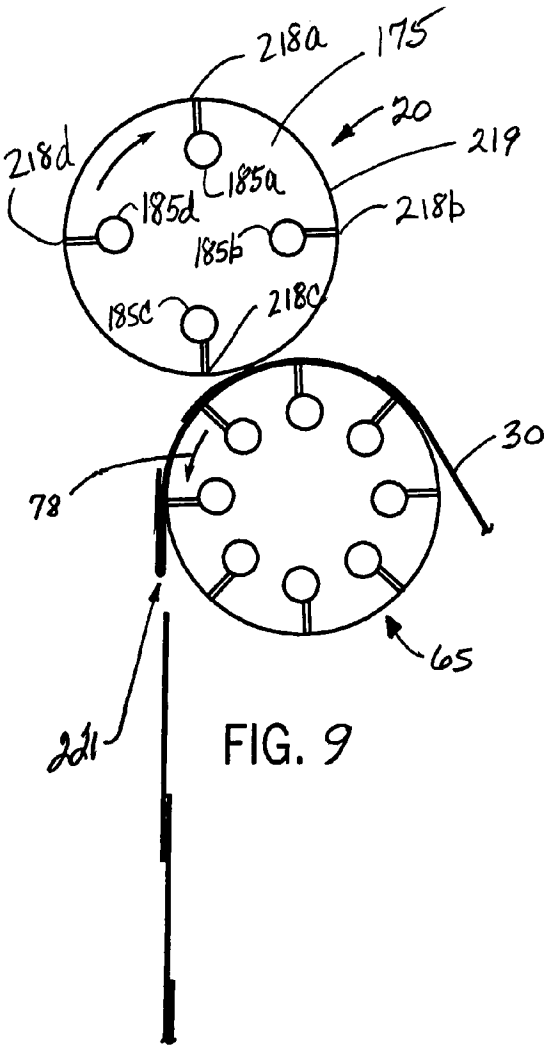
FIG. 9 is a schematic diagram similar to FIG. 8 completing a fold in of the sheet of material to form a separation in the sheets supplied to the folding rolls.
Figure 8:
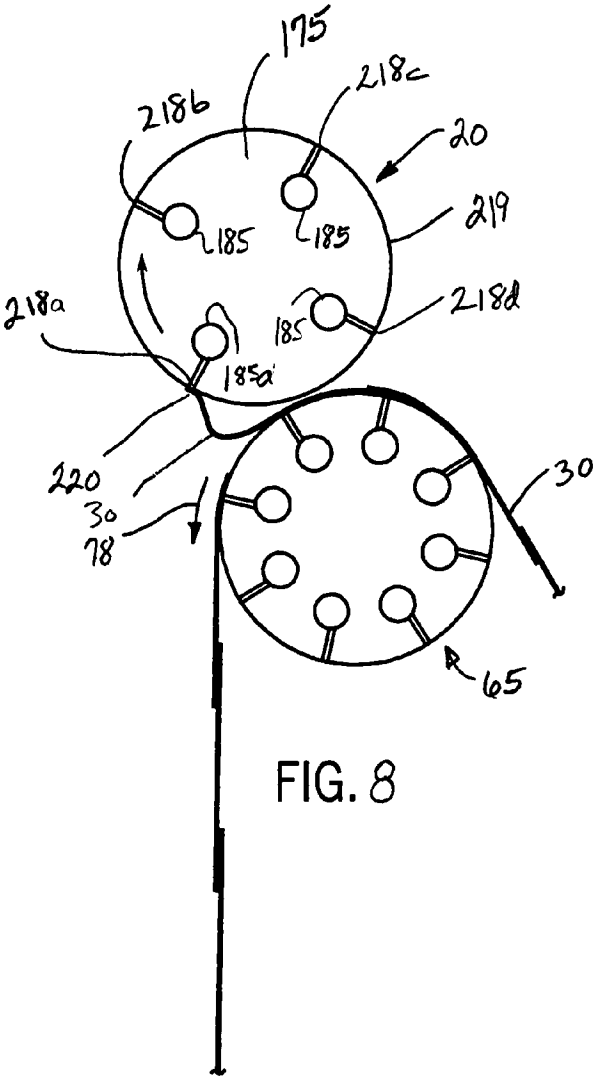
FIG. 8 is a schematic diagram of showing the count roll assembly of FIGS. 3–7 engaging a leading edge of a sheet of material from a lap roll assembly, at a desired sheet count.

In operation, when a desired sheet count is attained, the vacuum source is actuated to supply vacuum pressure to a selected one of vacuum inlet components 165*a*–165*d*, such as 165*a*. Vacuum pressure is transferred through one of the recesses in valve body 145, such as recess 148*a*, and through the recess opening such as 151*a* to the chamber or passage, such as 200*a*, in spool 140. In this manner, vacuum is supplied to the appropriate port path 185 and the associated set of vacuum ports, such as 218*a*, that open onto the surface of count roll 20. In this manner, the supply of vacuum to the vacuum ports such as 218*a* functions to engage the leading edge of a sheet 30 out of overlapping relationship with the trailing edge of the downstream sheet, as shown in FIG. 8. Continued rotation of count roll 20 folds the sheet 30 onto itself, to create a separation in the supply of sheets to the folding rolls. When count roll 20 attains a rotational position corresponding to the location at which sheet 30 is to be released, spool 140 is positioned so that the activated chamber or passage, such as 200*a*, enters opening 225 in OFF valve 155. As noted previously, this release of vacuum pressure releases engagement of the sheet 30 with the outer surface of count roll 20, so that the folded sheet 30 is release and continues in the path toward folding rolls 90, 95, as shown in FIG. 9.

The location at which activation or ON vacuum is supplied can be adjusted as desired by rotating the stationary valve body 145. Similarly, the location at which vacuum is cut off can be adjusted by rotation of OFF valve 155. Passages 151*a*–151*d* are in axial alignment with each other, which ensures that vacuum actuation occurs at a consistent point in the rotation of spool 140, regardless of which of vacuum inlets 165*a*–165 is actuated.

The present invention provides numerous advantages in operation, including the ability to closely control the location at which vacuum is supplied to and cut off from the vacuum ports of the count roll. In addition, the chambered design of the present invention increases the available valve switching time. In contrast to known valve assemblies, each chamber 200*a*–*d* has an available dead time in excess of two hundred-seventy degrees of rotation, during which the chamber can be energized or activated with vacuum pressure. This increase in the available switching time can increase the potential operating speed of the interfolding machinery. Furthermore, individual port activation provides the availability of any sheet count, including odd numbered counts. In contrast, known valve assemblies are only able to provide even numbered counts.

A wide variety of machines or systems could be constructed in accordance with the invention defined by the claims. Hence, although the exemplary embodiment of a count assembly 20 in accordance with the invention will be generally described with reference to an interfolding machine for counting overlapped sheets of material 30 to be interfolded into a stack 32, the application of the count assembly 20 is not so limited. The count assembly 20 of the invention could be employed to count a variety of web-materials being fed for a wide variety of uses and is not limiting on the invention.

The above discussion, examples, and embodiments illustrate our current understanding of the invention. However, since many variations of the invention can be made without departing from the spirit and scope of the invention, the invention resides wholly in the claims hereafter appended.

I claim:

1. A machine for handling sheets of material, comprising:

a roll including a plurality of vacuum passages configured to provide a vacuum pressure to an outer surface defined by the roll;

a vacuum assembly that communicates vacuum pressure to the roll, comprising:

a manifold having a plurality of vacuum inlet ports;

a valve body having a plurality of vacuum chambers;

a spool contained within the valve body, the spool being connected to the roll so as to rotate with the roll, and having a plurality of spool ports that define a plurality of respective vacuum paths which selectively communicate the vacuum pressure from the vacuum chambers of the valve body to the vacuum passages of the roll; and a release valve for selectively exposing at least one of the vacuum paths of the spool to atmosphere to cut off the supply of vacuum pressure to the vacuum passages.

2. The machine as recited in claim 1, wherein the vacuum assembly further includes a bearing that rotatably supports the spool.

3. The machine as recited in claim 1, wherein a vacuum assembly is connected at each of a pair of opposite ends defined by the roll.

4. The machine as recited in claim 1, wherein the spool includes a plurality of chambers that define the vacuum paths, each of the plurality of chambers communicating with one of the plurality of vacuum passages of the roll.

5. The machine as recited in claim 1, wherein the spool vacuum paths open onto an end defined by the spool, and wherein the release valve comprises a cover plate that overlies the end of the spool.

6. The machine as recited in claim 5, wherein the cover plate is spring-loaded against the end of the spool.

7. The machine as recited in claim 5, wherein the release valve includes a generally U-shaped opening configured to selectively align with and release vacuum pressure in the one or more vacuum paths of the spool.

8. The machine as recited in claim 1, wherein the manifold generally includes a plurality of manifold cover components connected to a plurality of vacuum inlet components, wherein each of the plurality of vacuum inlet components includes one of the plurality of vacuum inlet ports, and wherein each of the manifold cover components generally extends a first portion of a circumference of the valve body, wherein each of the vacuum inlet components generally extends a remaining circumference of the valve body, and wherein the vacuum inlet components and the cover components enclose recesses in the valve body that form the vacuum chambers.

* * * * *